US006332970B1

(12) United States Patent
Coffey

(10) Patent No.: US 6,332,970 B1
(45) Date of Patent: Dec. 25, 2001

(54) ELECTROLYTIC METHOD OF AND COMPOSITIONS FOR STRIPPING ELECTROLESS NICKEL

(76) Inventor: Barry W. Coffey, 2600 Roby Martin Rd., Lenoir, NC (US) 28645

( * ) Notice: Subject to any disclaimer, the term of this patent is extended or adjusted under 35 U.S.C. 154(b) by 0 days.

(21) Appl. No.: 09/425,054

(22) Filed: Oct. 22, 1999

(51) Int. Cl.[7] ..... C25F 5/00; H01B 1/00
(52) U.S. Cl. ..... 205/720; 205/723; 252/500
(58) Field of Search ..... 205/717–721, 205/723; 252/500

(56) References Cited

U.S. PATENT DOCUMENTS

| | | | | |
|---|---|---|---|---|
| 4,356,069 | | 10/1982 | Cunningham | 204/146 |
| 4,400,248 | * | 8/1983 | Tomaszewski | 205/723 X |
| 4,554,049 | | 11/1985 | Bastenbeck | 156/656 |
| 4,647,352 | | 3/1987 | Cook | 204/146 |
| 4,664,763 | | 5/1987 | McMullen et al. | 204/146 |
| 4,720,332 | | 1/1988 | Coffey | 204/146 |
| 5,062,941 | * | 11/1991 | Sue | 205/717 |
| 6,165,345 | * | 12/2000 | Updegrove et al. | 205/717 |

* cited by examiner

*Primary Examiner*—Donald R. Valentine
(74) *Attorney, Agent, or Firm*—Smith, Gambrell & Russell, LLP

(57) ABSTRACT

Electrolytic stripping solutions, which incorporate the novel use of oxoacids and/or oxoacid salts, and hydrogen peroxide, have been formulated for the rapid removal of electroless nickel from iron, steel, aluminum, and titanium alloys as well as other selected electrically conductive substrates. The formulations provide improved resistance to etching of the substrate and can be formulated to be free of chelates, chromates, nitrates, or concentrated acid solutions thereby increasing worker safety and reducing the cost of waste disposal of spent stripping solutions.

21 Claims, No Drawings

ELECTROLYTIC METHOD OF AND COMPOSITIONS FOR STRIPPING ELECTROLESS NICKEL

FIELD OF THE INVENTION

The present invention relates to an electrical stripping process and compositions for stripping electroless nickel from a substrate. An electrical stripping process can be described as the reverse of electroplating. While electroplating applies a coating of metal to a substrate, an electrical stripper removes a coating from the substrate. The coating is dissolved during electrolysis by combining with negative chemical ions in a bath, which are attracted to its surface by its positive potential. While the object of a stripper is to remove a coating without damage to the underlying substrate, most anodic reactions cannot differentiate between the coating and the substrate resulting in etching of that substrate.

Electroless nickel is a very chemical resistant coating and is difficult to attack. An illustration of its chemical resistant is the "nitric acid drop test". A drop of concentrated nitric acid is applied to the electroless nickel coating's surface. If any etching occurs within a set time period, the test fails. The discovery of relatively mild chemical formulations and procedures that will rapidly strip these very chemical resistant coatings is of great economic value. This is especially true when the stripping process can be made environmentally friendly and safe to use in the recovery of defectively plated parts.

DESCRIPTION OF THE RELATED ART

Since the invention of autocatalytic chemical nickel deposition (now commonly called electroless nickel plating), the excellent chemical resistance of the deposit has found wide use in protecting a variety of manufactured articles. This chemical resistance has been improved over the years through innovative formulations that modify the structure of the deposit to make it even more resistant to chemical attack. Not surprisingly, the task of stripping electroless nickel while saving the substrate has become increasingly difficult.

Various methods have been used to attempt to strip electroless nickel with varying degrees of success. One of the earliest methods tried was an electrolytic stripper which was in common use for stripping electrolytic nickel. The stripper was made from concentrated sulfuric acid, utilizing reverse current. Typically, a part to be stripped was immersed in a stripping bath and connected to the positive (anodic) lead of a direct current source. Current traversed the bath to the negative electrode (cathode) which was usually made of lead or graphite. The method utilized the principal of passivity, i.e., when the nickel deposit had been dissolved by the action of the sulfate ion, unlike the nickel, the chemical characteristics of the steel substrate in the presence of the very concentrated sulfuric acid would make the steel passive to attack and oxygen would be evolved. This method failed when trying to strip most electroless nickel deposits because, just as steel, the electroless nickel became passive.

U.S. Pat. No. 4,356,069 (Cunningham) describes an electrical nickel stripper composed of concentrated sulfuric acid, chromic acid, and hydrogen peroxide. This formulation claimed to strip chromium as well as nickel from ferrous substrates. While the patent does not claim that the formulation will strip electroless nickel deposits, it suffers from the disadvantages of high disposal costs of its large hazardous chromium and sulfuric acid content, and the added step of having to remove an oxide layer from the substrate before replating can be attempted.

Another chromic acid based electrical nickel stripper is described in U.S. Pat. No. 4,647,352 (Cook). This patent states that the combination of chromic acid, phosphoric acid, and sodium bisulfite can be used to electrically strip electroless nickel. The formulation suffers from its sensitivity to the introduction of sulfate ions to the bath which caused it to etch the substrate mandating the use of barium carbonate treatment. Disposal of spent stripping baths is very expensive due to the high chromic acid content.

U.S. Pat. No. 4,664,763 (McMullen et al.) discloses an aqueous stripping solution comprising chromic acid utilizing defectively plated parts as either or both the anode and cathode of an electrolytic stripping cell and applying an alternating current across the electrodes to strip the nickel coatings. Electrolytic and electrolysis nickel coatings are said to be stripped by this method. This stripping method cites several optional etch inhibitors, such as potassium iodide, to help prevent etching of the substrate. This method suffers from the possibility of etching and the high disposal cost of the high chromic acid content.

Other electrolytic stripping processes utilize nitrates, normally ammonium or sodium nitrate, at a concentration of about three pounds per gallon. These processes use reverse direct current to remove electroplated nickel and some low phosphorous electroless nickel deposits from iron and steel. As nickel dissolves, the stripping bath undergoes rapid pH changes that produce heavy sludging problems. Sporadic passivity of large areas of unstripped nickel occur as the exposed base metal becomes passive under the influence of the electric current causing an incompletely stripped part. The problem is more pronounced when trying to strip electroless nickel deposits above about seven percent phosphorous.

Immersion nickel strippers (no electrical current needed) were introduced that utilized soluble nitrobenzene compounds in solution with cyanide compounds to strip nickel deposits. These strippers found limited use for stripping electroless nickel with a low phosphorous content, i.e., 1%–7%, however, the higher phosphorous content electroless nickel deposits either did not strip or stripped at such low rates that the process proved to be impractical. With the advent of pollution controls, the use of cyanide became more and more expensive as the liability of disposal increased.

Nickel stripping baths that utilize water soluble nitrobenzene compounds, either ammonia and ammonium salts or ethylene diamine and/or its homologs, have gained wide acceptance. These baths work well on deposits of electrolytic nickel and some low phosphorous electroless nickels have achieved stripping rates of about 0.001 inch/hour, however, the high phosphorous content electroless deposits slowed the removal to, on average, less than 0.0003 inch an hour. Proper disposal of these types of stripping baths is very expensive because of their toxicity and high chelating power. These baths operate at about 160–190° Fahrenheit to strip electroless nickel coatings and are very vulnerable to damage by heat through loss of volatile chemicals components as well as thermal chemical decomposition.

U.S. Pat. No. 4,554,049 (Bastenbeck) discloses an immersion nickel stripper which uses sulfamic acid, hydrogen peroxide, nitrates, and chlorides. The patent claims to strip low phosphorous electroless nickel (less than 7%) but cannot effectively strip deposits of greater phosphorous content.

U.S. Pat. No. 4,720,332 (Coffey) describes a nickel stripping bath that utilizes soluble nitrobenzene compounds, Zwitterions (as chelating agents), sulfide producing compounds, carbonates, and the use of reverse current for the fast removal of electroless nickel deposits. While this method strips electroless nickel fast (up to 0.002 inch/hour) and works well, it sometimes microscopically etches in high current density areas dulling highly polished surfaces.

Thus, it is the objective of this invention to improve the art of stripping electroless nickel by providing formulations to electrolytically strip electroless nickel deposits of both low and high phosphorous content with equal high efficiency and ease.

It is also an objective of this invention to provide formulations to electrolytically strip electroless nickel with improved resistance to etching the substrate.

It is a further objective to provide a choice of alternative stripping formulations that are safer to use in the workplace and more environmentally friendly by eliminating chelates, nitrates, chromates, cyanide, and highly concentrated acidic solutions.

It is yet an objective to provide formulations and processes to strip electroless nickel from electrolytically deposited bright nickel, electrolytically deposited sulfamate nickel, and high nickel content alloys with little or no damage to the substrate.

SUMMARY OF THE INVENTION

The electrolytic stripping baths of the present invention are made from oxoacids, and/or oxoacid salts, and hydrogen peroxide. It has been discovered that electroless nickel deposits can be dissolved at the anode of electrolytic baths containing oxoacids, and/or oxoacid salts, and hydrogen peroxide. The substrates of iron, cast iron, steel alloy, stainless steel, and titanium are protected from attack during electrolyis if the hydrogen peroxide acid mole ratio is maintained above a mininum preferred mole ratio of about 3.75 for strong oxoacids with one ionizable hydrogen and about 7.5 hydrogen peroxide/oxoacid mole ratio for strong oxoacids with two or more ionizable hydrogens. Peroxide/oxoacid ratios as low as 1.5 may be used when combining weak oxoacids with weak oxoacid salts to construct a stripping bath. To prevent attack on aluminum substrates only sulfuric and sulfamic acids and/or their salts may be selected from the strong oxoacids while any of the hydrogen peroxide compatible weak oxoacids and/or salts may be used Only combinations of weak oxoacids and/or oxoacid salts should be used when stripping from the substrates of electroplated nickel, cast nickel, KOVAR (iron, nickel, cobalt alloy), and sulfamate nickel.

For purposes of this invention an acid is considered strong if it has a dissociation constant ($K_1$) greater than about $2\times10^{-1}$. Examples of strong oxoacids include sulfuric, nitric, sulfamic, alkyl sulfonic, aryl sulfonic, and monoalkyl esters of sulfuric acid.

Examples of weak oxoacids include phosphoric, pyrophosphoric, alkyl phosphoric, glucophosphonic, oxalic, formic, propanoic, bis methanol propanoic, acetic, butanoic, benzoic, phthalic, citric, tartaric, malic, malonic, maleic, butyric, succinic, glycolic, glutaric, gluconic, adipic, boric, ethylenediaminetetraacetic and homologs, nitrilotriacetic, amino acetic, and polyvinyl sulfonic acid.

The concentration of hydrogen peroxide for the application of this invention can range from about one percent to about 99 percent, but a concentration of about eight percent is preferred. While maintaining the disclosed minimum peroxide/oxoacid mole ratios the oxoacid and/or oxoacid salts may vary from 0.01 mole/liter to saturation.

The pH range for implementation of the invention is about 0–8, while the preferred pH range is about 1–7, and the most preferred range is about 1.5–4.5.

The oxygen free halogen acids (hydrofluoric and hydrochloric are excluded from the invention because there seems to be no hydrogen peroxide/acid ratio that will prevent attack on iron or steel substrates when these acids and/or their salts are used in the stripping bath in amounts above about 0.1 mole/liter. Iodic, bromic, and chromic acids and/or salts are excluded because of their incompatibility with hydrogen peroxide either upon mixing with peroxide or during the stripping process.

DETAILED DESCRIPTION OF THE INVENTION

The present invention discloses that electroless nickel deposits can be electrolytically stripped from substrates of iron, cast iron, steel alloy, stainless steel, aluminum, and titanium utilizing stripping baths made from selected oxoacids and/or oxoacid salts and hydrogen peroxide. Surprisingly, electrolytically deposited nickel, cast nickel, KOVAR and high nickel alloy substrates can be stripped of electroless nickel deposits without significant substrate attack provided tile stripping bath is made from weak oxoacids and/or oxoacid salts. Electroless nickel can be stripped from aluminum substrates without significant attack only if the strong oxoacids and/or strong oxoacids salts are selected from sulfuric acid and its salts and/or sac acid and its salts. Any of the hydrogen peroxide compatible weak oxoacids and/or oxoacid salts many be used to strip electroless nickel from aluminum, The base metals are protected from attack during electrolysis if the hydrogen peroxide/oxoacid mole ratio is maintained above a minimum of about 3.75 for strong oxoacids with one ionizable hydrogen and about 7.5 hydrogen peroxide/oxoacid mole ratio for strong oxoacids with two or more ionizable hydrogens. Peroxide/oxoacid ratios as low as 1.5 may be used when combining weak oxoacids and/or weak oxoacid salts to construct a stripping bath.

The oxygen free halogen acids (hydrofluoric and hydrochloric) are excluded from this invention because there is no apparent concentration of hydrogen peroxide that will prevent attack of iron, steel alloy, and aluminum substrates when these acids are present in the stripping bath at a concentration greater than about 0.1 mole/liter. Very small amounts of halogen ions do not seem to attack the substrate if accompanied in solution by relatively large amounts of oxoacid ions. For example, the amount of chloride ion resulting from chlorination of drinking water does not seem to affect the substrate, however, if the concentration of chloride ion rises above about 0.1 mole per liter, some attack of the substrate may result.

Practical considerations such as bath conductivity and operator safety have lead to a preferred working range of about 5–20% by volume hydrogen peroxide (10–40% by volume using 50% hydrogen peroxide) and a most preferred working range of7–10% by volume hydrogen peroxide (14–20% by volume using 50% hydrogen peroxide). Using the proper hydrogen peroxide/acid mole ratio for this range of hydrogen peroxide concentration allows stripping at current densities up to about 100 amps/sq.ft. There is no maximum concentration limitation for the hydrogen peroxide except for the practical considerations of operator safety, disposal considerations, etc.

The concentration of oxoacid and/or oxoacid salts may vary over wide limits as long as the minimum peroxide/acid mole ratios are maintained. The acid and/or salts may vary from 0.01 mole/liter to saturation. However, since the current that flows through the bath determines the amount of nickel stripped during a time period, it is preferred that the stripping bath have a low electrical resistance. Therefore, selection of the amount and type of oxoacids and/or oxoacid salts that increase the conductivity of the solution is of great importance for the rapid and economic removal of the electroless nickel coating.

The preferred temperature range for operating the stripping baths of this invention is about 60–115° F., and the most preferred is about 80–100° F. Of course, lower or higher temperatures may be used, however, lower conductivity and solubility will be experienced at lower temperatures, and accelerated peroxide decomposition may occur at higher temperatures.

EXAMPLES

The following examples are given to demonstrate the application of the invention but not limit in any way the scope of the invention:

Example 1

The following bath was not chelated which makes waste treatment of spent stripping baths of this formulation simple and low in cost. It contained only about three times the acetic acid content of ordinary vinegar which makes it very safe to use. While the peroxide content was high enough to bleach hair, it is not a high enough concentration to be a serious hazard to workers.

| CHEMICAL | AMOUNT |
|---|---|
| Monosodium Phosphate | 20 grams |
| Acetic Acid (68%) | 20 milliliters |
| Hydrogen Peroxide (50%, v) | 25 milliliters |
| Water (Tap) to make a total volume of 140 milliliters | |
| Peroxide/Acid Mole Ratio: 1.82 | |

The above chemicals were dissolved to make a total solution volume of 140 milliliters. The temperature of the solution was adjusted to 90° Fahrenheit. Two one inch wide stainless steel cathodes were placed into the solution on either side of the beaker that contained the solution and connected to the negative side of a variable voltage direct current power supply. A one-inch wide mild steel panel that had been previously plated with 0.001-inch electroless nickel containing about 12% phosphorous was suspended in the middle of the beaker between the two stainless steel cathodes. The plated panel was connected to the positive side of the power supply. A TEFLON® (polytetrafluoroethylene) coated stirring rod was placed in the beaker and was used to slowly stir the solution to prevent stratification of the bath. The current was applied and the voltage drop across the stripping bath was adjusted to four. After a momentary formation of bubbles on the plated part, the nickel began to dissolve into the stripping bath and all bubbling at the anode stopped. The starting current was 0.75 amps. After about thirty minutes, the steel base metal began to be exposed at the 90-degree angles on the bottom of the plated part. Unlike nitrate based electrolytic strippers, the exposed steel substrate did not gas. The electroless nickel coating continued to dissolve, and as it receded, it assumed a parabolic shape as it shrank from all sides of the panel. Only when the remaining electroless nickel coated area covered about 30% of the area of the panel exposed to the solution did gassing slowly began to occur from the base metal. After about forty-five minutes, no electroless nickel could be seen on the panel. An additional fifteen minutes of time was allowed to insure complete stripping and to see if any etching would occur on the steel panel. Examination revealed no etching. The mild steel panel was bright and polished just as it was when first immersed into the electroless nickel plating solution.

Aluminum test panels were also stripped in this solution with equally good results.

The following examples were constructed as in Example 1 and illustrate the varied oxoacids and/or oxoacid salts that may be used in this invention:

Example 2

| CHEMICAL | AMOUNT |
|---|---|
| Sodium Hydrogen Sulfate | 12 grams |
| Sodium Sulfate | 15 grams |
| Hydrogen Peroxide (50%) | 35 milliliters |
| Water to made a total solution volume of 140 milliliters | |
| Peroxide/Acid Mole Ratio: 6.1 | |

This bath had less resistance to the flow of current than Example 1 and the starting current was 1.02 amperes at a starting voltage drop across the bath of four volts. An identical panel to the one used in Example 1 was stripped in about thirty minutes with identical good results.

Example 3

| CHEMICAL | AMOUNT |
|---|---|
| Sulfuric Acid (66° Baume) | 2.35 milliliters |
| Hydrogen Peroxide (50%) | 35 milliliters |
| Water to made a total solution volume of 140 milliliters | |
| Peroxide/Acid Mole Ratio: 15.0 | |

This bath was constructed as in Example 1. This bath had very good conductivity. It stripped from the substrates of steel, aluminum, and titanium with no visible attack. 2.35 grams of nickel were introduced into the bath and calculations showed that 97.9% of the acid had been used to react with nickel. Additional use of this bath caused the pH to rise rapidly from the 4.8 pH that was measured when the nickel content reached 2.35 grams. Continued stripping caused precipitation of nickel hydroxide and rapid decomposition of the hydrogen peroxide as the pH reached about 6–7. No additions of hydrogen peroxide were necessary during the test.

Example 4

| CHEMICAL | AMOUNT |
|---|---|
| Citric Acid | 10 grams |
| Trisodium Citrate | 10 grams |
| Hydrogen Peroxide (50%) | 20 milliliters |
| Water to made a total solution volume of 140 milliliters | |
| Peroxide/Acid Mole Ratio: 6.79 | |

Good results on substrates of steel, aluminum, titanium, and cast iron were obtained.

Example 5

| CHEMICAL | AMOUNT |
|---|---|
| Ammonium sulfate | 14 grams |
| Hydrogen Peroxide (50%) | 20 milliliters |
| Water to made a total solution volume of 140 milliliters | |

This bath stripped electroless nickel well with no apparent attack on steel, however, the bath became turbid with nickel hydroxide as the pH climbed to 6–7. Peroxide became more unstable as the pH climbed above 5.5.

Example 6

| CHEMICAL | AMOUNT |
|---|---|
| Magnesium Sulfate | 15 grams |
| Hydrogen Peroxide (50%) | 25 milliliters |
| Water to made a total solution volume of 140 milliliters | |

This bath stripped electroless nickel without attack on steel, however, peroxide decomposition was rapid due to the high pH of 6–8 during the test.

Example 7

| CHEMICAL | AMOUNT |
|---|---|
| Trisodium Citrate | 10 grams |
| Citric Acid | 10 grams |
| Hydrogen Peroxide (50%) to make 140 milliliters of bath | |
| Peroxide/Acid Mole Ratio: 44.4 | |

This bath was used to test the upper limit of hydrogen peroxide concentration. The bath worked well with no discernable difference from those obtained in Example 4.

Example 8

| CHEMICAL | AMOUNT |
|---|---|
| Monosodium Phosphate | 15 grams |
| Citric Acid | 10 grams |
| Hydrogen Peroxide (50%) | 20 milliliters |
| Water to make a total solution volume of 140 milliliters | |
| Peroxide/Acid Mole Ratio: 7.4 | |

This bath stripped well to 60 amps./sq.ft. Some heating of the solution was noted due to the bath's electrical resistance. The bath stripped 3.25 mills of electroless nickel in one hour and ten minutes. No attack on steel substrate was noted. No discernable attack on steel or aluminum substrates was observed.

Example 9

| CHEMICAL | AMOUNT |
|---|---|
| Sulfamic Acid | 10 grams |
| Trisodium Phosphate | 10 grams |
| Hydrogen Peroxide (50%) | 20 milliliters |
| Water to make a total solution volume of 140 milliliters | |
| Peroxide/Acid Mole Ratio: 3.4 | |

This bath was tested to 60 amps./sq. ft. No attack on steel, aluminum, or titanium base metals was observed.

Example 10

| CHEMICAL | AMOUNT |
|---|---|
| Formic Acid | 10 milliliters |
| Sodium Formate | 10 grams |
| Hydrogen Peroxide (50%) | 25 milliliters |
| Water to make a total solution volume of 140 milliliters | |
| Peroxide/Acid Mole Ratio: 2.1 | |

This bath gave good results stripping nickel from steel, aluminum, and cast iron substrates.

Example 11

| CHEMICAL | AMOUNT |
|---|---|
| Acetic Acid (68%, v.) | 10 milliliters |
| Sodium Acetate | 10 grams |
| Hydrogen Peroxide (50%) | 20 milliliters |
| Water to make a total solution volume of 140 milliliters | |
| Peroxide/Acid Mole Ratio = 3.1 | |

This bath stripped about 10 times slower at four volts than the bath in Example 1 because of poor bath conductivity. The bath does not attack steel substrate.

Example 12

| CHEMICAL | AMOUNT |
|---|---|
| Sodium Sulfate | 10 grams |
| Glutaric Acid | 10 grams |
| Hydrogen Peroxide (50%) | 22 milliliters |
| Water to make a total solution volume of 140 milliliters | |
| Peroxide/Acid Mole Ratio = 5.1 | |

This bath dissolved 2.51 grams of electroless nickel before the test was terminated at pH 4.4. No attack on steel substrate was observed.

Example 13

| CHEMICAL | AMOUNT |
|---|---|
| Sodium Chloride | 5 grams |
| Acetic Acid (68%) | 10 milliliters |
| Hydrogen Peroxide (50%) | 20 milliliters |
| Water to make a total solution volume of 140 milliliters | |
| Peroxide/Acid Mole Ratio = 3.1 | |

With this bath, steel base metal etched because of the high chloride content.

Example 14

| CHEMICAL | AMOUNT |
|---|---|
| Sodium Chlorate | 8 grams |
| Acetic Acid (68%) | 20 milliliters |

-continued

| CHEMICAL | AMOUNT |
|---|---|
| Hydrogen Peroxide (50%) | 20 milliliters |
| Water to make a total solution volume of 140 milliliters | |
| Peroxide/Acid Mole Ratio = 1.5 | |

This bath stripped very well and did not etch steel, contrary to the results in Example 13.

Example 15

| CHEMICAL | AMOUNT |
|---|---|
| Citric Acid (MW = 210) | 10 grams |
| Sodium Sulfate | 10 grams |
| Hydrogen Peroxide (50%) | 30 milliliters |
| Water to make a total solution volume of 140 milliliters | |
| Peroxide/Acid Mole Ratio = 11.1 | |

The bath stripped 4.2 grams nickel which is the stoichiometric equivalent of the citric acid in the bath. The pH of the bath began to rise rapidly and the test was terminated. No attack on steel, aluminum, cast iron, or titanium substrates was noted.

Example 16

| CHEMICAL | AMOUNT |
|---|---|
| Maleic Acid | 10 grams |
| Hydrogen Peroxide (50%) | 22 milliliters |
| Water to make a total solution volume of 140 milliliters | |
| Peroxide/Acid Mole Ratio = 4.5 | |

With this bath, good performance and reduced conductivity were observed.

Example 17

| CHEMICAL | AMOUNT |
|---|---|
| Sulfuric Acid ($66^0$ Baume) | 3 milliliters |
| Borax | 12 grams |
| Hydrogen Peroxide (50%) | 22 milliliters |
| Water to make a total solution volume of 140 milliliters | |
| Peroxide/Acid Mole Ratio = 7.4 | |

This bath stripped well. No attack on steel or aluminum substrates was observed. High bath conductivity was noted. The bath stripped at 100 amp./ft.$^2$ with no visual attack on steel or aluminum substrates.

Example 18

| CHEMICAL | AMOUNT |
|---|---|
| Glycolic Acid (commercial) | 10 milliliters |
| Sodium Sulfate | 10 grams |
| Hydrogen Peroxide (50%) | 22 milliliters |

-continued

| CHEMICAL | AMOUNT |
|---|---|
| Water to make a total solution volume of 140 milliliters | |
| Peroxide/Acid Mole Ratio = 2.9 | |

This bath stripped well. No attack on steel or aluminum base metals was observed.

Example 19

| CHEMICAL | AMOUNT |
|---|---|
| Phosphoric Acid (85%, v.) | 15 milliliters |
| Hydrogen Peroxide (50%) | 25 milliliters |
| Water to make a total solution volume of 140 milliliters | |
| Peroxide/Acid Mole Ratio = 2.9 | |

This bath stripped well. No attack on steel or aluminum base metals was observed.

Example 20

| CHEMICAL | AMOUNT |
|---|---|
| Boric Acid | 5 grams |
| Sodium Sulfate | 10 grams |
| Hydrogen Peroxide (50%) | 20 milliliters |
| Water to make a total solution volume of 140 milliliters | |
| Peroxide/Acid Mole Ratio = 4.4 | |

The beginning pH of this bath was 5.32. When the pH reached 5.84, a precipitate began to form in the bath. The nickel content of the bath was 0.6 grams. Although nickel hydroxide was precipitating, stripping continued with no attack on steel or aluminum substrates.

Example 21

| CHEMICAL | AMOUNT |
|---|---|
| Sodium Hydrogen Sulfate | 10 grams |
| Sodium Pyrophosphate | 10 grams |
| Hydrogen Peroxide (50%) | 25 milliliters |
| Water to make a total solution volume of 140 milliliters | |
| Peroxide/Acid Mole Ratio = 5.3 | |

This bath stripped electroless nickel well. No attack on steel or aluminum plated substrates was observed.

Example 22

| CHEMICAL | AMOUNT |
|---|---|
| Citric Acid | 15 grams |
| Sodium Tripolyphosphate | 10 grams |
| Hydrogen Peroxide (50%) | 25 milliliters |
| Water to make a total solution volume of 140 milliliters | |
| Peroxide/Acid Mole Ratio = 6.2 | |

This bath gave good results when stripping from electroplated nickel, cast nickel, and KOVAR alloy.

Example 23

| CHEMICAL | AMOUNT |
|---|---|
| Acetic Acid (68%) | 20 milliliters |
| Sodium Nitrate | 15 grams |
| Hydrogen Peroxide (50%) | 20 milliliters |
| Water to make a total solution volume of 140 milliliters | |
| Peroxide/Acid Mole Ratio = 1.5 | |

This bath stripped electroless nickel deposits at near 100% efficiency. No visible attack on steel substrates was observed. Bright electrolytically deposited nickel was slowly (oxygen liberated at nickel's surface) dissolved in this bath because of the nitrate content. Aluminum substrates were slowly attacked.

Example 24

| CHEMICAL | AMOUNT |
|---|---|
| Citric Acid | 15 grams |
| Ammonium Nitrate | 50 grams |
| Hydrogen Peroxide (50%) | 25 milliliters |
| Water to make a total solution volume of 140 milliliters | |
| Peroxide/Acid Mole Ratio = 6.1 | |

This bath stripped bright electroplated nickel with less efficiency, i.e., some gassing occurs as the electroplated nickel was dissolved. However, 12% high phosphorous electroless nickel deposits were stripped at near 100% efficiency. This formulation is an improvement over prior art because it allows the use of an acid to keep the pH from rising to a point where nickel hydroxide precipitation causes sludging of the bath which is an inherent deficiency of prior art nitrate electrolytic strippers. It also allows the nitrate based formulation to strip high phosphorous electroless nickel and bright electroplated nickel in one stripping bath with no attack on steel or cast iron substrates. Aluminum substrates are attacked.

Example 25

| CHEMICAL | AMOUNT |
|---|---|
| Nitric Acid (68%, v.) | 6 milliliters |
| Hydrogen Peroxide (50%) | 20 milliliters |
| Water to make a total solution volume of 140 milliliters | |
| Peroxide/Acid Mole Ratio = 3.7 | |

This bath stripped bright electroplated nickel with gassing of oxygen. It stripped electroless nickel very rapidly because of high conductivity. With this bath, aluminum substrates, but not steel or titanium substrates, were attacked.

Example 26

The following example has a volume of one liter. This bath illustrates a very low peroxide/oxoacid concentration of 0.3/0.04 moles.

| CHEMICAL | AMOUNT |
|---|---|
| Sulfuric Acid (66$^{o}$ Baume) | 2.3 milliliters |
| Hydrogen Peroxide (50%) | 17 milliliters |
| Water to make a total solution volume of one liter | |
| Peroxide/Acid Mole Ratio = 7.5 | |

Although its conductivity was reduced, this bath stripped electroless nickel of 12% phosphorous content with no discernable attack on steel or aluminum test panels.

Example 27

| CHEMICAL | AMOUNT |
|---|---|
| Methane Sulfonic Acid | 9 milliliters |
| Hydrogen Peroxide (50%) | 20 milliliters |
| Water to make a total solution volume of 140 milliliters | |
| Peroxide/Acid Mole Ratio = 3.75 | |

This bath had high conductivity. It stripped electroless nickel from steel, cast iron, titanium, and cast nickel without discernable attack. Aluminum substrates were slowly attacked.

Example 28

| CHEMICAL | AMOUNT |
|---|---|
| Benzene Sulfonic Acid | 14.8 grams |
| Hydrogen Peroxide (50%) | 20 milliliters |
| Water to make a total solution volume of 140 milliliters | |
| Peroxide/Acid Mole Ratio = 3.75 | |

The results obtained were identical to those obtained in Example 27.

The following examples illustrate attack on the substrate because of low peroxide/oxoacid ratios:

Example 29

| CHEMICAL | AMOUNT |
|---|---|
| Sulfuric Acid (66$^{o}$ Baume) | 5.4 milliliters |
| Hydrogen Peroxide (50%) | 20 milliliters |
| Water to made a total solution volume of 140 milliliters | |
| Peroxide/Acid Mole Ratio = 3.75 | |

A one-inch wide unplated steel test panel was immersed into the solution and was immediately attacked before electrical connection was made to the test panel. This panel was replaced with another steel panel that was plated with 0.001 inch electroless nickel. The panel was connected to the positive lead of the power supply as in Example 1 and voltage was adjusted to four volts. The electroless nickel was rapidly dissolved because of the high current density. After the panel was stripped of electroless nickel and the part was being removed from the stripping bath, it was explosively attacked by the stripping solution remaining on its surface.

Example 30

| CHEMICAL | AMOUNT |
|---|---|
| Acetic Acid (68%) | 20 milliliters |
| Sodium Sulfate | 10 grams |
| Hydrogen Peroxide (50%) | 10 milliliters |
| Water to make a total solution volume of 140 milliliters | |
| Peroxide/Acid Mole Ratio = 0.77 | |

An unplated test panel identical to that of Example 29 was immersed into the stripping solution without electrical contact. The test panel was very slowly attacked by the solution. As in Example 29, the panel was replaced by a plated one and stripped. When the panel was removed, the steel base metal was attacked but was not explosive in its rate of attack. Addition of 15 milliliters of hydrogen peroxide (50%) to the above bath stopped all the etching and produced results identical to those obtained in Example 1.

While the invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the appended claims.

Thus, it is to be understood that variations in the present invention can be made without departing from the novel aspects of this invention as defined in the claims. All patents cited herein are hereby incorporated by reference in their entirety and relied upon.

What is claimed is:

1. A method for stripping electroless nickel deposits from a substrate selected from the group consisting of iron, cast iron, steel alloy, stainless steel, aluminum, electroplated nickel, cast nickel, iron/nickel/cobalt alloy, sulfamate nickel and titanium, the method comprising:

a) immersing the substrate containing an electroless nickel deposit into a composition in an electrolytic bath, said composition comprising:

i) a compound selected from the group consisting of oxoacids, oxoacid salts, and combinations thereof, and ii) hydrogen peroxide; and b) stripping the electroless nickel deposits from the substrate by electrolysis, wherein a hydrogen peroxide/acid mole ratio of at least 3.75 is maintained for strong oxoacids having one ionizable hydrogen and a dissociation constant of at least $2\times10^{-1}$, wherein a hydrogen peroxide/acid mole ratio of at least 7.5 is maintained for strong oxoacids having at least two ionizable hydrogens, and wherein a hydrogen peroxide/acid mole ratio of at least 1.5 is maintained for weak oxoacids having a dissociation constant less than $2\times10^{-1}$, with the proviso that, when aluminum is the substrate and strong oxoacids are used in the composition, said strong oxoacids are selected from the group consisting of sulfuric acid, sulfamic acid, their salts, and combinations thereof, and with the proviso that, when the substrate is selected from electroplated nickel, cast nickel, iron/nickel/cobalt alloy, and sulfamate nickel substrates, weak oxoacids, oxoacid salts, and combinations thereof are used in the composition.

2. The method of claim 1, wherein said strong oxoacids are selected from the group consisting of sulfuric, nitric, sulfamic, alkyl sulfonic, aryl sulfonic and monoalkyl esters of sulfuric acid.

3. The method of claim 1, wherein said weak oxoacids are selected from the group consisting of phosphoric, pyrophosphoric, alkyl phosphoric, glucophosphonic, oxalic, formic, propanoic, bis methanol propanoic, acetic, butanoic, benzoic, phthalic, citric, tartaric, malic, malonic, maleic, butyric, succinic, glycolic, glutaric, gluconic, adipic, boric, -ethylenediaminetetraacetic and homologs, nitrilotriacetic, amino acetic, and polyvinyl sulfonic acid.

4. The method of claim 1, wherein said hydrogen peroxide is present in said composition at a concentration between 1 and 99% by volume.

5. The method of claim 4, wherein said hydrogen peroxide is present at a concentration of about 8% by volume.

6. The method of claim 1, wherein the compound selected from the group consisting of oxoacids, oxoacid salts and combinations thereof is present in said composition at a concentration between 0.01 mole/liter and saturation.

7. The method of claim 1, wherein said composition is maintained at a pH of between 0 and 8.

8. The method of claim 7, wherein said composition is maintained at a pH of between 1.5 and 4.5.

9. The method of claim 1, wherein said composition is maintained at a temperature between 60 and 115° F.

10. The method of claim 9, wherein said composition is maintained at a temperature between 80 and 100° F.

11. A composition for electrolytically stripping electroless nickel deposits from a substrate, comprising:

a) a compound selected from the group consisting of oxoacids, oxoacid salts, and combinations thereof, and b) hydrogen peroxide, wherein a hydrogen peroxide/acid mole ratio of at least 3.75 is maintained for strong oxoacids having one ionizable hydrogen and a disociation constant of at least $2\times10^{-1}$, wherein a hydrogen peroxide/acid mole ratio of at least 7.5 is maintained for strong oxoacids having at least two ionizable hydrogen, and wherein a hydrogen peroxide/acid mole ratio of at least 1.5 is maintained for weak oxoacids having a dissociation constant less than $2\times10^{-1}$.

12. The composition of claim 11, wherein said strong oxoacids are selected from the group consisting of sulfuric, nitric, sulfamic, alkyl sulfonic, aryl sulfonic and monoalkyl esters of sulfuric acid.

13. The composition of claim 11, wherein said weak oxoacids are selected from the group consisting of phosphoric, pyrophosphoric, alkyl phosphoric, glucophosphonic, oxalic, formic, propanoic, bis methanol propanoic, acetic, butanoic, benzoic, phthalic, citric, tartaric, malic, malonic, maleic, butyric, succinic, glycolic, glutaric, gluconic, adipic, boric, ethylenediaminetetraacetic and homologs, nitrilotriacetic, amino acetic, and polyvinyl sulfonic acid.

14. The composition of claim 11, wherein said hydrogen peroxide is present in said composition at a concentration between 1 and 99% by volume.

15. The composition of claim 14, wherein said hydrogen peroxide is present at a concentration of about 8% by volume.

16. The composition of claim 11, wherein the compound selected from the group consisting of oxoacids, oxoacid salts, and combinations thereof, is present in said composition at a concentration between 0.01 mole/liter and saturation.

17. The composition of claim 11, wherein said composition has a pH of between 0 and 8.

18. The composition of claim 17, wherein said composition has a pH of between 1.5 and 4.5.

19. The composition according to claim 11, wherein the composition does not contain a chelate, a chromate nor a cyanide.

20. A method for stripping electroless nickel deposits from a substrate selected from the group consisting of iron, cast iron, steel alloy, stainless steel, aluminum, electroplated nickel, cast nickel, iron/nickel/cobalt alloy, sulfite nickel and titanium, the method comprising:

a) immersing a substrate containing an electroless nickel deposit into a composition in an electrolytic bath, said composition consisting essentially of i) a compound selected from the group consisting of oxoacids, oxoacid salts, and combinations thereof, and ii) hydrogen peroxide; and b) stripping the electroless nickel deposits from the substrate by electrolysis, wherein a hydrogen peroxide/acid mole ratio of at least 3.75 is maintained for strong oxoacids having one ionizable hydrogen and a dissociation constant of at least $2\times10^{-1}$, wherein a hydrogen peroxide/acid mole ratio of at least 7.5 is maintained for strong oxoacids having at least two ionizable hydrogens, and wherein a hydrogen peroxide/acid mole ratio of at least 1.5 is maintained for weak oxoacids having a dissociation constant less than $2\times10^{-1}$, with the proviso that, when aluminum is the substrate and strong oxoacids are used, said strong oxoacids are selected from the group consisting of sulfuric acid, sulfamic acid, their salts, and combination thereof, and with the proviso that, when the substrate is selected from electroplated nickel, cast nickel, iron/nickel/cobalt alloy, and sulfamate nickel substrates, weak oxoacids, oxoacid salts, and comnbinations thereof, are used in the composition.

21. A composition for electrolytically stripping electroless nickel deposits from a substrate, consisting essentially of:

a) a compound selected from the group consisting of oxoacids, oxoacid salts, and combinations thereof; and b) hydrogen peroxide, wherein a hydrogen peroxide/acid mole ratio of at least 3.75 is maintained for strong oxoacids having one ionizable hydrogen and a dissociation constant of at least $2\times10^{10-1}$, wherein a hydrogen peroxide/acid mole ratio of at least 7.5 is maintained for strong oxoacids having at least two ionizable hydrogens, and wherein a hydrogen peroxide/acid mole ratio of at least 1.5 is maintained for weak oxoacids having a dissociation constant less than $2\times10^{-1}$.

* * * * *